US005218990A

United States Patent [19]

Amrhein

[11] Patent Number: 5,218,990

[45] Date of Patent: Jun. 15, 1993

[54] MULTIWAY VALVE WITH PISTON SLIDE VALVE

[75] Inventor: Reinhard Amrhein, Frammersbach, Fed. Rep. of Germany

[73] Assignee: Mannesmann Rexroth GmbH, Main, Fed. Rep. of Germany

[21] Appl. No.: 794,227

[22] Filed: Nov. 19, 1991

[30] Foreign Application Priority Data

Dec. 11, 1990 [DE] Fed. Rep. of Germany ..... 4039522

[51] Int. Cl.[5] ..... F15B 13/04

[52] U.S. Cl. ..... 137/312; 137/625.68; 137/625.69

[58] Field of Search ..... 137/312, 625.68, 625.69

[56] References Cited

U.S. PATENT DOCUMENTS 3,516,445 6/1970 Skeates ..... 137/312 X
4,566,479 1/1986 Rotte et al. ..... 137/312

FOREIGN PATENT DOCUMENTS 1245662 7/1967 Fed. Rep. of Germany ..... 137/312
3309065 9/1984 Fed. Rep. of Germany .

*Primary Examiner*—John C. Fox
*Attorney, Agent, or Firm*—Oblon, Spivak, McClelland, Maier & Neustadt

[57] ABSTRACT

A multiway valve, which includes a piston slide valve and at least five control chambers, of which a middle chamber comprises an intake chamber for a pressure medium, chambers adjacent the middle chamber are connected to actuators, and chambers outside the adjacent chambers are connected to a reservoir at a preset pressure level wherein, in the area of piston guide gaps formed between the intake chamber and actuator chambers, a first annular space is provided, which in a middle position of the position slide valve, in which an intake of the pressure medium source and connections of the actuators are closed, is connected by ducts in the piston slide valve to a reduced pressure level source. In order to keep flow medium from being able to penetrate from the reservoir into one of the actuator chambers in the area of the piston guide gaps between the actuator chamber and the intake chamber, a second annular space is provided, which by means of a radial duct provided in the piston slide valve leads into a piston slide valve recess from which the radial duct of an adjacent annular space originates and which, only in the middle position of the piston slide valve, is connected by a duct guide provided in the valve piston to a common valve space connected to an overflow oil line, the common valve space being located laterally beside the chambers and the flow paths within the piston slide valve between the chambers and the piston slide valve recesses being separated from one another over the entire length thereof.

14 Claims, 3 Drawing Sheets

MULTIWAY VALVE WITH PISTON SLIDE VALVE

BACKGROUND OF THE INVENTION

1. Field of the Invention

The present invention relates to a multiway valve with a piston slide valve and at least five control chambers.

2. Discussion of the Background

A multiway valve is described, for example, in DE-PS 33 09 065. In this known case the ducts in the piston slide valve are formed by blind holes, which, on the one hand, are connected by radial bores in the piston slide valve to the corresponding annular space in the area of the guide gaps adjacent to the intake connection and, on the other hand, by other radial bores connected to the corresponding connection leading to the tank. In the neutral position of the multiway valve these two radial bores are open to the control chambers connected to the tank, while with the deflection of the piston slide valve from the center position into one or the other direction in each case a radial bore can be covered by the housing of the valve.

With this design of the multiway valve it is possible with the piston slide valve located in the blocking position to prevent effectively and with the least possible production and assembly expenditures overflow of the pressure medium from the intake chamber to the two actuator control chambers. Thus a particular advantage results from the fact that the housing of a conventional multiway valve can be used without any changes and only an exchange of the piston slide valve is needed to avoid an undesirable pressure buildup in the actuator connections.

However, limits of this usual multiway valve appear if there is a question of effectively excluding flow medium or pressure medium entries into the actuator connections if the tank itself is under pressure. Under these conditions, with known piston slide valves the pressure medium, due the fit clearance between piston slide valve and valve housing land, can reach the pressure medium in the adjacent operating pipe or actuator connection, which has an especially negative effect in the control of very sensitive actuators.

SUMMARY OF THE INVENTION

Therefore, the object of the invention is to further develop the multiway valve of the initially described type so that even if all control chambers of the valve conduct pressure, with a simple production of the valve an undesirable pressurization of the actuator connections with flow pressure medium can be safely avoided.

This object is achieved with a multiway valve with the features of claim 1.

According to the invention, another annular space provided in the area of each of the piston slide valve gaps between the respective actuator chamber on both sides of the pressure medium connection and the adjacent tank chamber, a space which leads by a related radial duct in the piston slide valve into a piston slide valve recess, from which the radial duct of the adjacent annular space originates and which, only in the middle position of the piston slide valve by a related duct guide in the valve piston, is connected to a common valve space connected to an overflow oil line, which is placed laterally beside the valve control chambers, and the respective flow ducts within the piston slide valve from the valve chamber to the related piston slide valve recesses are separated from one another. In this manner an additional advantage results in that the switch position of the multiway valve the piston slide valve recesses with the related radial ducts can be used to make available additional fluid paths for the connection of the interconnected control chambers.

As a result, according to the invention a discharge takes place of overflow fluid from the tank control chamber entering the fit clearance in two flow medium paths, separated from one another in the piston slide valve, which are brought together only in a common valve chamber. Thus it is guaranteed that in the shifting of the piston slide valve, both duct guides or flow medium paths of the housing allocated to the related annular spaces are closed, so that escape of flow medium from a control connection conducting pressure into the area of the overflow oil line can be reliably eliminated.

A particularly simple embodiment of the design of separate flow paths for the gradual shutoff of possible leakage flow medium amounts from the tank connection into the area of the operating connections results from the further development according to claim 2. With this configuration any additional processing on the valve housing can be eliminated, by which it is possible to work with valve housings with standard connections of the valves. Especially ducts and connections are eliminated in the housing, which would involve a comparatively expensive processing. It has been shown that by the special design of the valve piston a separate flow medium leakage escape into the common valve chamber connected to a overflow oil line can be made available, if a suitable connection technique between the two components of the piston slide valve, namely, the outside piston slide valve sleeve and the inside piston core, is used. Especially good results can be achieved with a brazing connection, and the brazed areas in each case have the same outside diameter. Processing of the piston components in this manner becomes comparatively simple and is limited to an accurate production of a continuous inside bore in the piston sleeve and an accurate outside processing of the core piston, by which the quality of the fit surfaces can be kept at a very high level.

The core piston is preferably designed as a hollow piston and for this purpose is provided with blind holes, which are closed on one end with a screw.

Other advantageous configurations are the object of the remaining subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
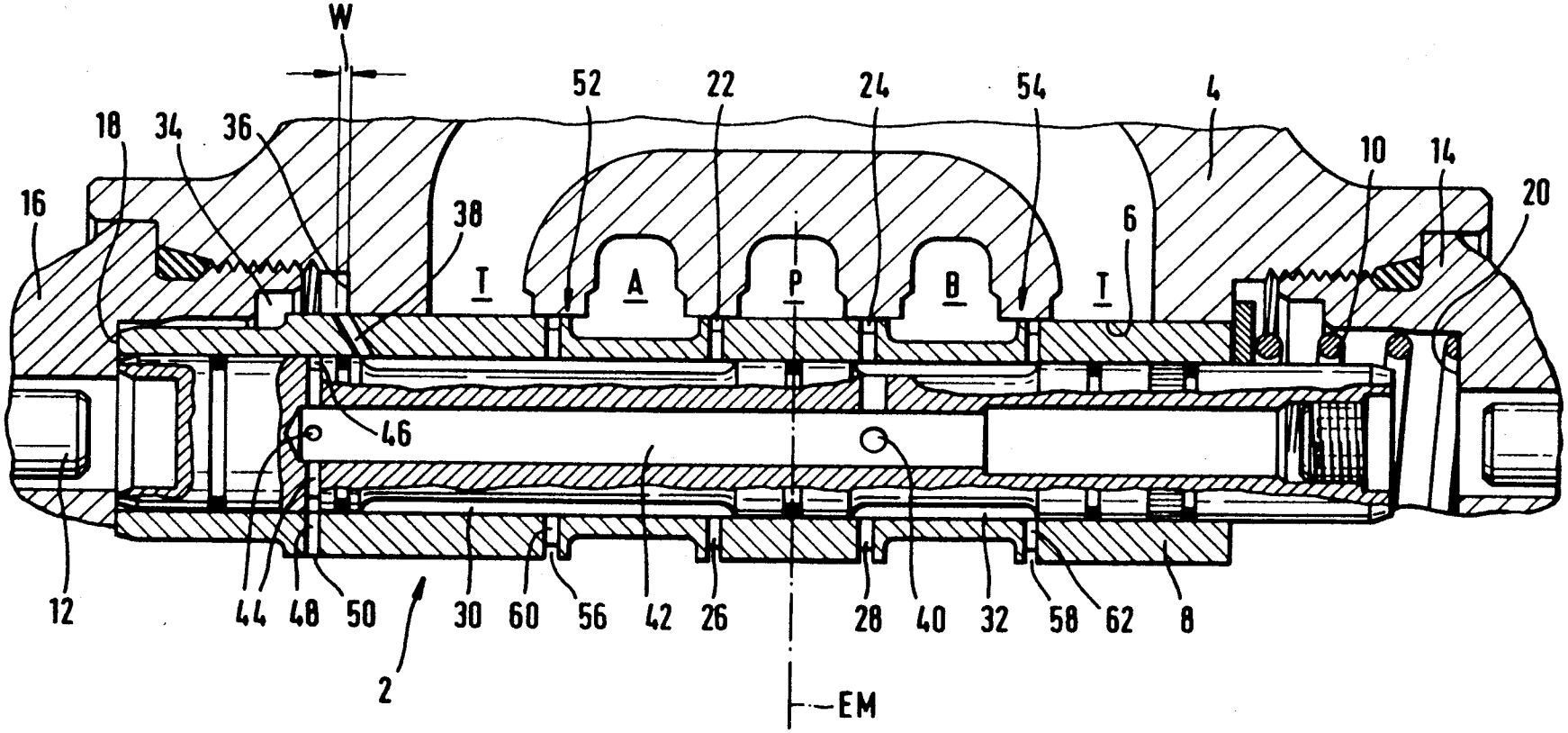
FIG. 1 shows a section through a multiway valve wherein the piston slide valve is located in the neutral or zero position.

As FIG. 1 shows, multiway valve 2 exhibits a valve housing 4, which is provided with a bore 6, in which a piston slide valve 8 which can be shifted by sliding is received. Piston slide valve 8 can be shifted from the neutral position represented in FIG. 1 against the force of a valve spring 10, for example, by the action of an armature plunger 12 of an operating magnet (not shown).

Bore 6 in valve housing 4 is closed at both ends by a closing part 14 or 16, and a shoulder 18 on closing part 16 determines the neutral position of piston slide valve 8 while a shoulder 20 on closing part 14 defines a support surface for valve spring 10.

The multiway valve has five control chambers, which are designated by letters T, A, P and B. Control chamber P represents the intake chamber for the pressure medium and is connected to a pressure medium source. Chambers A and B form connections to the actuators and control chambers T are connected to the tank or reservoir.

It can be seen that in the neutral position of the valve all control chambers are separated from one another. In this switch position, for effectively keeping the pressure medium of intake control chamber P from penetrating into a control chamber A or B leading to the actuators by the clearance fit gap between piston slide valve 8 and the inside surface of bore 6, there are provided, in the area of the clearance fit gaps on both sides of intake control chamber P, annular grooves or spaces 22 or 24 in the form of annular grooves in piston slide valve 8, which are connected by radial ducts in the form of radial bores or ducts 26 or 28 respectively in a space or recesses 30 or 32 inside piston slide valve 8. Each of spaces 30, 32 in the illustrated neutral position of the valve is connected by separate duct guides in piston slide valve 8 to a lateral valve space 34, which is connected to an overflow oil line, not shown in greater detail. In the represented embodiment, valve space 34 is defined by the inside front portion of closing part 16 and by a step 36 of valve housing 4.

The pressure release of annular space 22 takes place in this case by an axial extension of space 30 and duct 38, and runs obliquely outward, which leads into valve space 34. The pressure release of annular space 24 takes place because space 32 is connected by at least one radial bore 40 to a central recess 42 in piston slide valve 8, and because this central recess 42, preferably in the form of a blind hole, in the area of lateral valve space 34 is connected by at least one other radial bore 44 in an intermediate position of an annular space 46 and at least one other outside radial bore 48 to valve space 34. In this manner two flow medium leakage paths result, which are completely separated from one another within piston slide valve 8 from respective annular space 22 or 24 up to emptying into the common release valve space 34. Duct 38 basically runs radially and in this case empties into valve space 34 so that the outlet opening, after a very short displacement path of piston slide valve 8, can be covered by housing bore 6. Outlet opening 50 of outside radial bore 48 is slightly offset in the axial direction to the outlet opening of duct 38.

Moreover, for effectively keeping the flow medium from valve control chambers T from penetrating by the clearance fit surfaces between piston slide valve 8 and bore 6 into respective actuator chambers A or B, which, for example, in hydraulic systems could be the case in which the tank is under pressure, in the area of piston guide gaps or gap members 52 or 54 between the lateral tank control chambers and the respective adjacent actuator control chambers A or B other annular grooves or spaces 56, 58 are provided, which are connected by radial ducts 60 or 62 to that space 32 or 30 in piston slide valve 8, from which also originates radial bore 28 or 26 of adjacent annular space 24 or 22. In other words, additional guide gap 52 or 54 is connected by the corresponding radial duct 60 or 62 to the above-described pressure release duct guide in the piston slide valve. The pressure medium, which, for example, penetrates from reservoir connection control chamber T, on the right side according to FIG. 1, of multiway valve 2 into piston guide gaps 54, is conducted by annular space 58 and radial duct 62, which preferably is designed as a radial bore, into valve space 32 and by means of the at least one radial bore 40 can flow out into central recess 42. From there it proceeds by radial bores 44 and the flow path by annular space 46 and outside radial bore 50 into valve space 34. In this manner a pressure buildup in actuator chamber B is effectively prevented. The flow medium from left tank control chamber %, according to FIG. 1, on a correspondingly shorter flow medium path is drained off by annular space 56, radial bore 60, valve space 30 and duct 38. The double-walled configuration of piston slide valve 8 and the separation of valve spaces 32, 30 from one another create the condition for a bypass to be formed for leakage flow from space 32 over flow medium connection P.

Figure 2:
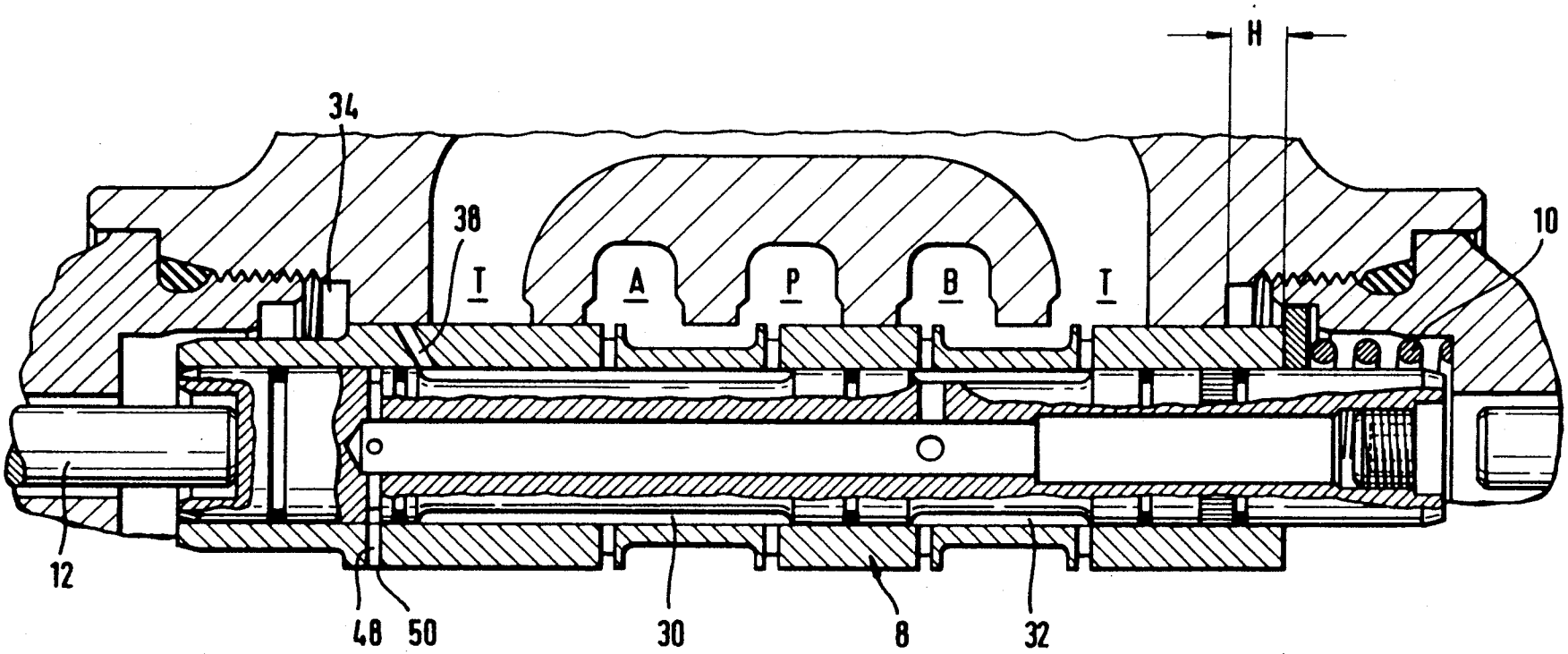
FIG. 2 shows a view of the multiway valve similar to FIG. 1 wherein the piston slide valve occupies a switch position.

The switch position of multiway valve 2 is represented in FIG. 2. In this case, piston slide valve 8 is moved from the neutral position according to FIG. 1 by a distance H. As a result, the connection progresses from chamber P to chamber A and chamber B to chamber T, and at the same time both outlet opening 50 of outside radial duct 48 and cutoff duct 38 are steered by valve bore 6. By the above-described structure complete separation occurs of the release flow medium paths inside piston slide valve 8. Also in this switch position a flow connection is effectively prevented from occurring between one of chambers A or P and one of chambers B or T. However, by the configuration according to the invention of the multiway valve the especially additional advantage is obtained that additional flow medium paths from pump chamber P to actuator chamber A or from actuator chamber B to tank chamber T are made available by spaces 30 or 32.

Figure 3:
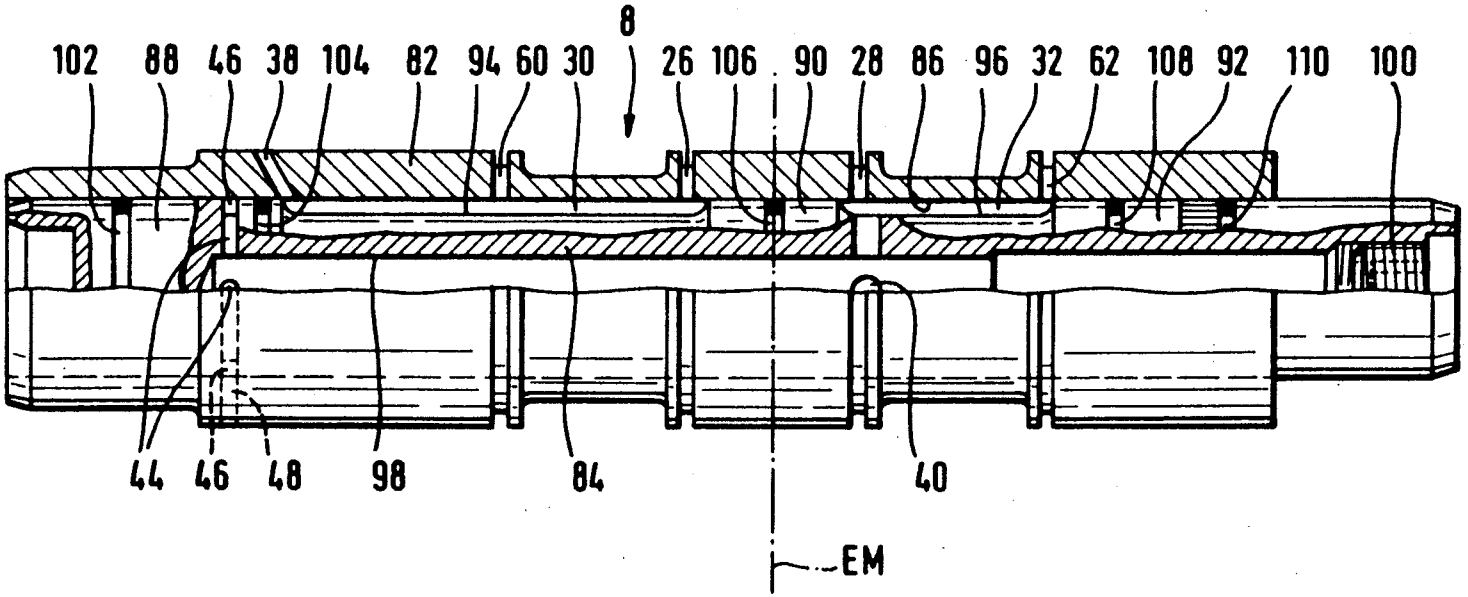
FIG. 3 shows a side view of the piston slide valve partially in section.

It is clear from the above description that the design according to the invention of the multiway valve opens up the possibility of using a usual valve housing with standardized connections, and additional processing steps in the area of the valve housing can be completely eliminated. This can be ascribed to the particular configuration of piston slide valve 8, which is to be described in greater detail below with reference to FIG. 3.

Piston slide valve 8 consists of two parts, namely a piston slide valve sleeve 82 and a piston core part 84, which is to be designated below as a core piston. Piston slide valve sleeve 82 exhibits a cylindrical finely worked inside bore 86, in which core piston 84 is fitted. Core piston 84 is designed so as to be cylindrical and exhibits between its three main lands 88, 90, 92 recesses 94 or 96 by which the initially described spaces 30 or 32 are formed in combination with piston slide valve sleeve 82.

Core piston 84 is provided with a blind bore 98, which is closed on the end side by a nut 100. Several radial bores 40, which lead into blind bore 98, are formed in the area of recess 96. Radial bores 44 run out into an annular groove 46 in the outside periphery of core piston 84 so that at least one outside radial bore 48 is sufficient to produce the flow medium path for valve space 34.

A brazing connection between core piston 84 and piston slide valve sleeve 82 is provided in the area of main lands 88, 90, 92. For this purpose recesses 102, 104, 106, 108 and 110 are present in the outside surface of core piston 84, in which a brazing ring is inserted. With these inserted brazing rings an oil tight brazing in the vacuum take place, and it has been shown that pressure seals at least up to 320 bars can be achieved. Nut 100 additionally can be glued to the thread. Preferably it is screwed in with a sealant.

For further simplification of the processing of the valve components, the release annular spaces are formed between valve control chambers A, T, P, B in piston slide valve sleeve 82, namely preferably in the form of recesses. Radial ducts 26, 28, 60, 62, 38 and 48 are formed by radial bores. In this manner a piston slide valve 8 very complex in design results but which can be produced by simple processing and assembly steps.

The above-described multiway valve is not limited to the specific described embodiment. It is also possible to assign another switch position to piston slide valve 8, but then care has to be taken that in this further switch position covering of radial ducts 48 and 38 again occurs.

Because of the symmetrical arrangement of actuator chambers P, T relative to intake P and radial ducts 26, 28, 60, 62 relative to a median plane EM, the intake of piston slide valve 9 can be turned in standard bore 6 of housing 4 even by 180°. Closing parts 14, 16 can then be exchanged and the magnet can be shifted to the side of closing part 16. In the switch position of the valve, then a progression from chambers P to B and from chambers T to A takes place.

The invention thus provides a multiway valve with a piston slide valve and at least five control chambers, of which the middle one is designed as an intake chamber for the pressure medium, the adjacent chambers are provided connected to actuators and the outside chambers are provided with a connection to a preset pressure level, such as, e.g., to the tank pressure level. In the area of the piston guide gaps between intake element and actuator chamber, an annular space is provided in each case, which in the middle position of the piston slide valve, in which the intake of the pressure medium source and the connections of the actuators are closed toward one another and toward the tank connections, is connected by appropriate ducts in the piston slide valve with a connection of a reduced pressure level. In any case, in order to keep the flow medium from penetrating from the tank connections into one of the actuator connections, in the area of the piston guide gaps between actuator and tank chamber in each case, another annular space is provided, which by a related radial duct in the piston slide valve leads into a piston slide valve recess, from which the radial duct of the adjacent annular space originates and which only in the middle position of the piston slide valve is connected by a related duct guide in the valve piston to a common valve space connected to an overflow oil line. The valve space is placed laterally beside the valve chambers, and the flow paths within the piston slide valve between the valve chamber and the related piston slide valve recesses are separated from one another over the common length.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A multiway valve, which comprises:

a valve housing;

a piston slide valve having first radial ducts and second radial ducts and first and second valve recesses from which the first and second radial ducts extend;

at least five control chambers positioned in said valve housing, including a pressure medium intake chamber, first and second adjacent chambers connected to actuators, and first and second adjacent outside tank chambers connected to a reservoir tank;

first piston guide gap members located between the intake chamber and the actuator chambers;

first annular grooves formed in said piston slide valve in an area adjacent the first piston guide gap members and which, in a middle position of the piston slide valve in which the intake of the pressure medium source and the connections of the actuators are closed off from communication with one another and closed off from the reservoir, are connected to a reduced pressure source by said first radial ducts in the piston slide valve;

second annular grooves formed in said piston slide valve in an area adjacent second piston guide gap members located between the actuator chambers and the adjacent tank chambers, respectively, wherein the second annular grooves, via said second radial ducts, lead into said first and second piston slide valve recesses and wherein only in the middle position of the piston slide valve are the second annular grooves connected by said second radial ducts of the piston slide valve to a common valve space connected to an overflow oil line, the valve space being located laterally inside the valve chambers and the piston slide valve forming separated flow paths which communicate the valve space to the first and second annular grooves on each side of the intake chamber.

2. A multiway valve according to claim 1, wherein the piston slide valve comprises a core piston inserted in a piston slide valve sleeve for releasing pressure in the second valve recess by said ducts, said piston housing an axial inside recess, which, on the one hand, is connected by at least one radial duct of said ducts to the second valve recess and, on the other hand, is connected by a third radial duct formed in said core piston to one of the flow paths which leads into the valve space.

3. A multiway valve according to claim 2, wherein said core piston comprises a cylindrical body with a substantially uniform outside diameter and having an outside surface in which two recesses are formed, which in combination with an inside bore portion of said piston slide valve sleeve forms said first and second valve recesses.

4. A multiway valve according to claim 3, wherein said core piston has a blind hole formed therein and wherein a screw is positioned in said blind hole.

5. A multiway valve according to claim 2, wherein said core piston has a blind hole formed therein and wherein a screw is positioned in said blind hole.

6. A multiway valve according to claim 2, wherein said core piston is brazed to said piston slide valve sleeve, and separated flow paths for pressure release in the piston slide valve are sealed from one another by solder contact surfaces.

7. A multiway valve according to claim 1, wherein the first and second radial ducts include an axial extension of the first valve recess and a branch duct which extends axially outward therefrom.

8. A multiway valve according to claim 7, wherein said core piston has a blind hole formed therein and wherein a screw is positioned in said blind hole.

9. A multiway valve according to claim 1, wherein said first and second annular grooves comprise recesses formed in said piston slide valve.

10. A multiway valve according to claim 1, wherein said valve comprises 4/2-way valve which includes a return spring and an overflow oil connection wherein the piston slide valve is shiftable against the force of the return spring from a neutral position into a position connecting at least one of the first and second adjacent chambers to said pressure medium intake chamber and the other of said first and second adjacent chambers to one of the first and second tank chambers, and the valve space is connected to the overflow oil line and is formed on a side of the slide valve opposite said return spring.

11. A multiway valve according to claim 1, wherein the control chambers and the first and second radial ducts are positioned symmetrically with respect to a median plane, so that the piston slide valve can be mounted in one of two positions in the valve housing oriented 180° with respect to one another.

12. A multiway valve according to claim 1, wherein the width of said first and second annular grooves is smaller respectively than the diameter of the first and second radial ducts.

13. A multiway valve according to claim 1, wherein the first and second radial ducts include an axial extension of the first valve recess and a branch duct which extends axially outward therefrom.

14. A multiway valve according to claim 1, wherein said core piston comprises a cylindrical body with a substantially uniform outward diameter and having an outside surface in which two recesses are formed, which in combination with an inside bore portion of said piston slide valve sleeve forms said first and second valve recesses.

* * * * *